US006092992A

United States Patent [19]

Imblum et al.

[11] Patent Number: 6,092,992

[45] Date of Patent: Jul. 25, 2000

[54] SYSTEM AND METHOD FOR PUMP CONTROL AND FAULT DETECTION

[76] Inventors: Gregory G. Imblum, 2057 Haymaker Rd., Monroeville, Pa. 15146; Charles H. Etheridge, 326 Edgewood Rd., Pittsburgh, Pa. 15221; William R. Frank, 5755 Howe St. #1, Pittsburgh, Pa. 15232

[21] Appl. No.: 08/736,466

[22] Filed: Oct. 24, 1996

[51] Int. Cl.[7] ..... F04B 49/00

[52] U.S. Cl. ..... 417/42; 417/44.11; 417/45; 417/53

[58] Field of Search ..... 417/42, 44.11, 417/45, 53

[56] References Cited

U.S. PATENT DOCUMENTS

| | | | |
|---|---|---|---|
| 4,401,926 | 8/1983 | Morton et al. | 318/376 |
| 4,864,287 | 9/1989 | Kierstead | 340/648 |
| 5,295,790 | 3/1994 | Bossart et al. | 417/43 |
| 5,447,414 | 9/1995 | Nordby et al. | 417/20 |
| 5,736,823 | 4/1998 | Nordby et al. | 318/432 |

FOREIGN PATENT DOCUMENTS

| | | |
|---|---|---|
| 4444810 | 6/1996 | Germany . |
| 63294292 | 3/1989 | Japan . |
| 2280762 | 2/1995 | United Kingdom . |

*Primary Examiner*—Charles G. Freay

[57] ABSTRACT

The present invention provides a system and a method for controlling and detecting faults in a pump system for use in a gas detection device. The system comprises a power source and a switch in operative or electrical connection with the power source. The system further comprises a pump motor in operative connection with the switch such that the pump motor receives energy from the power source when the switch in a first state, and the pump motor does not receive energy from the power source when the switch in a second state. The system preferably also comprises regeneration circuitry in operative connection with the pump motor. The regeneration circuitry operates to redirect energy produced from momentum of the pump motor while the switch is in the second state back to the pump motor. Transmitting circuitry is preferably provided to transmit a motor signal proportional to the speed of the pump motor during the second state of the switch. Preferably, the switch is modulated between the first state and the second state using a processing or control unit such as a microprocessor. The processing unit preferably controls the modulation of switch in response to the motor signal received from the transmitting circuitry.

20 Claims, 4 Drawing Sheets

SYSTEM AND METHOD FOR PUMP CONTROL AND FAULT DETECTION

FIELD OF THE INVENTION

The present invention relates to a system and to a method for controlling pumps and, particularly, to a system and a method for controlling and for detecting faults in pumping systems used in gas detection devices.

BACKGROUND OF THE INVENTION

Gas detection instruments often use a pneumatic pump to draw a gas sample to the instrument from a remote location. Such pumps are used, for example, to sample the environment in a confined space (such as a manhole or a hold of a ship) before entry into the confined space. Pneumatic pumps also allow use of an extending sample probe to search for leaks along a gas line or for gas accumulations on a floor or a ceiling.

Most portable gas detection instruments run on batteries. If the pump motor is powered directly from the battery, the pump speed (and the flow rate) will decrease as the battery discharges. For this reason, motors are typically chosen to run at a voltage lower than the lowest anticipated battery voltage, and circuitry is added to maintain this voltage constant. To maximize battery life, an efficient method of driving the motor at the lower voltage must be employed. It is also desirable to run the pump at nearly a constant flow rate to minimize variations in the output of the one or more sensors of the gas detection instrument since sensor output may vary with flow rate.

To ensure proper operation, gas detection instruments incorporating pneumatic pumps typically require a device/method to control flow rate and to detect blocked flow or unacceptable flow rate decreases. In the pumping system disclosed in U.S. Pat. No. 5,295,790, a flow meter is used to directly measure volumetric flow rate through the pump and to provide feedback to a motor control circuit such that flow is controlled with accuracy regardless of variations in pump characteristics. Although feedback of a direct measurement of volumetric flow rate is an excellent method of pump control and fault detection in a gas detection instrument, it often requires a significant increase in manufacturing cost.

Manufacturing cost can be somewhat decreased through the use of simple volumetric flow meters such as rotometers for the detection of flow faults, but the performance of such rotometers is sensitive to the positioning thereof. Moreover, rotometers do not automatically activate an electronic alarm system and thus require constant operator observation.

Many portable gas detection instruments with pneumatic pumps use some form of electronic flow control/fault detection mechanisms based on an "indirect" or "inferential" measurement of flow rate. For example, a number of such instruments use hot wire anemometers or mass flow sensors to measure mass flow. These instruments, however, suffer from high power requirements, large size and high manufacturing costs.

Another common "indirect" method to detect blocked flow is the measurement of inlet suction at the pump. In general, a vacuum switch is used to produce an electrical signal when the suction exceeds a preset limit. While satisfactory as a detection scheme, the vacuum switches available for use in small, portable gas detection instruments have proven to be expensive and prone to mechanical or electrical failure in long term use.

Given the above-discussed and other drawbacks associated with current systems and methods for flow control and fault detection, it is very desirable to develop efficient and cost effective systems and methods for controlling and for detecting faults in pumping systems used in gas detection devices.

SUMMARY OF THE INVENTION

The present invention provides generally a system for controlling a pump for use in a gas detection device and, particularly, in a portable gas detection device. The system comprises a power source and a switch in operative or electrical connection with the power source. The system further comprises a pump motor in operative connection with the switch such that the pump motor receives energy from the power source when the switch is in a first state, and the pump motor does not receive energy from the power source when the switch is in a second state.

Preferably, the switch is modulated between the first state and the second state using a processing or control unit such as a microprocessor or a microcontroller. Transmitting circuitry is preferably provided to transmit a motor signal proportional to the speed of the pump motor to the microcontroller. The processing unit preferably controls the modulation of switch in response to the motor signal received from the transmitting circuitry.

The system preferably also comprises regeneration circuitry in operative connection with the pump motor. The regeneration circuitry operates to redirect energy produced from momentum of the pump motor while the switch is in the second state back to the pump motor.

The present inventors have discovered that the modulation control of the pump motor in a gas detection instrument enables efficient control of the pump motor and the detection of many fault conditions or flow problems. Such problems can arise, for example, from a complete or partial blockage in the sample flow line or from a malfunction of the pump motor. In that regard, the processing unit preferably comprises a comparing mechanism which compares the motor signal with a predetermined value or range of acceptable values to determine if a fault condition is present. Preferably, the processing unit also includes a control mechanism to periodically cause the switch to remain in the second state for a period of time sufficiently long to cause a stall of the pump motor (that is, sufficiently long to slow the rotation of the pump or to stop the pump motor). The processing unit restarts the pump motor after the period of time by restarting modulation of the switch at a predetermined duty cycle. Stalling the pump motor, requires greater torque during a start-up cycle than required to simply maintain a substantially constant motor speed. The motor signal during the restart or start-up cycle provides an indication of whether a fault condition is present.

The processing unit also preferably includes a measuring mechanism to measure the rate of change of the modulation of the switch required to control the pump motor and to compare the measured rate of change with a predetermined acceptable rate of change to determine whether a fault condition is present.

The present invention also provides a method for controlling a pump motor for use in a gas detection instrument. The method comprises the steps of:

a. supplying energy to the pump motor from a power source;

b. modulating a switch connected between the power source and the pump motor between a first state in which the pump motor receives energy from the power source and a second state in which the pump motor does not receive energy from the power source, c. measuring a motor signal proportional to a speed of the pump motor; and d. controlling the modulation of the switch in response to the motor signal to control the pump motor.

Preferably, the motor signal is compared with a predetermined range of acceptable values to determine whether a fault condition is present.

The method preferably further comprising the steps of:

e. periodically causing the switch to be in the second state for a period of time sufficiently long cause a stall of the pump motor;

f. restarting modulation of the switch after the period of time; and g. measuring the motor signal at a predetermined time after restarting modulation of the switch to determine whether a fault condition is present.

The method also preferably includes the steps of measuring the rate of change of the modulation of the switch required to control the pump motor and comparing the measured rate of change with a predetermined acceptable rate of change to determine whether a fault condition is present.

The method also preferably includes the step of redirecting energy produced from rotation of the pump motor when the switch is in the second state back to the pump motor.

DETAILED DESCRIPTION OF THE INVENTION

Figure 1:
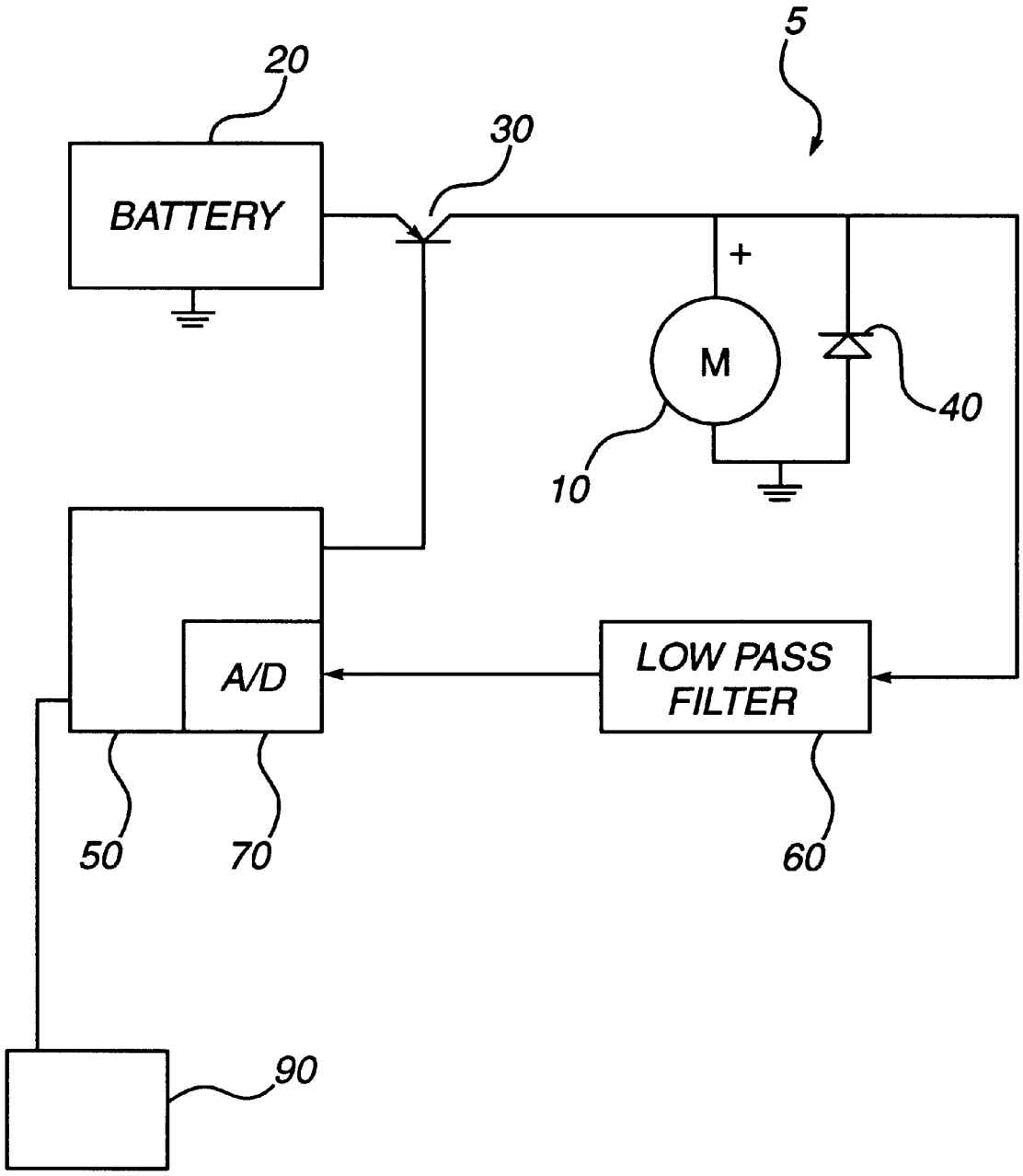
FIG. 1 is a schematic illustration of an embodiment of a control system of the present invention.

As illustrated in FIG. 1, system 5 preferably comprises a pump motor 10 which drives a pump (not shown). Motor 10 is preferably supplied energy from a battery 20 via a switch mechanism such as a transistor switch 30 using Pulse Width Modulation (PWM). In PWM, the battery voltage is generally pulsed on and off hundreds of times per second. The time duration or duty cycle of each pulse is varied to control the speed of motor 10. While transistor switch 30 is on, battery 20 supplies power to motor 10 which energizes the windings of motor 10 and causes motor 10 to turn. While transistor switch 30 is off, motor 10 continues to turn because of its momentum and acts like a generator to produce back electromotive force (emf). The energy (that is, the back emf) can be redirected back to motor 10 using regeneration circuitry 40 comprising, for example, one or more diodes connected across motor 10. This technique is known as regeneration. The back emf can also be used to provide feedback to control motor 10.

Preferably, a motor signal proportional to a voltage across the windings of motor 10 while switch 30 is in the off state is measured and used to control motor 10. There are a number of ways in which a motor signal proportional to the voltage across the windings during the off portion of the PWM cycle can be measured. For example, the approximate voltage at any defined instant during the off portion of each cycle can be measured. Further, the approximate average voltage developed across motor 10 during the off portion of the PWM cycle can be measured. Preferably, the approximate average voltage developed across motor 10 during both the off portion and the on portion of the PWM cycle is measured.

Each of the above measurements is proportional to the voltage contributed by the regeneration phase of the cycle. The voltage contributed by the regeneration phase is, in turn, proportional to the speed of motor 10. Under light load conditions, motor 10 runs at a relatively high speed and generates a high voltage. When the load on motor 10 increases, motor 10 runs at a lower speed (assuming the energizing pulse has not changed) and the voltage decreases. Preferably, a microprocessor or microcontroller 50 measures the voltage decrease and then increases the pulse width (or duty cycle) proportionally to compensate for the load until the motor voltage is back to its normal operating value or within its normal operating range. In one embodiment of the present invention, for example, a Motorola Model No. 68HC11K1 microcontroller was used to control the motor speed. When the load is removed, motor 10 will speed up momentarily and increase the voltage. Microcontroller 50 adjusts the duty cycle until the voltage is again back to its normal operating value or range.

Figure 2:
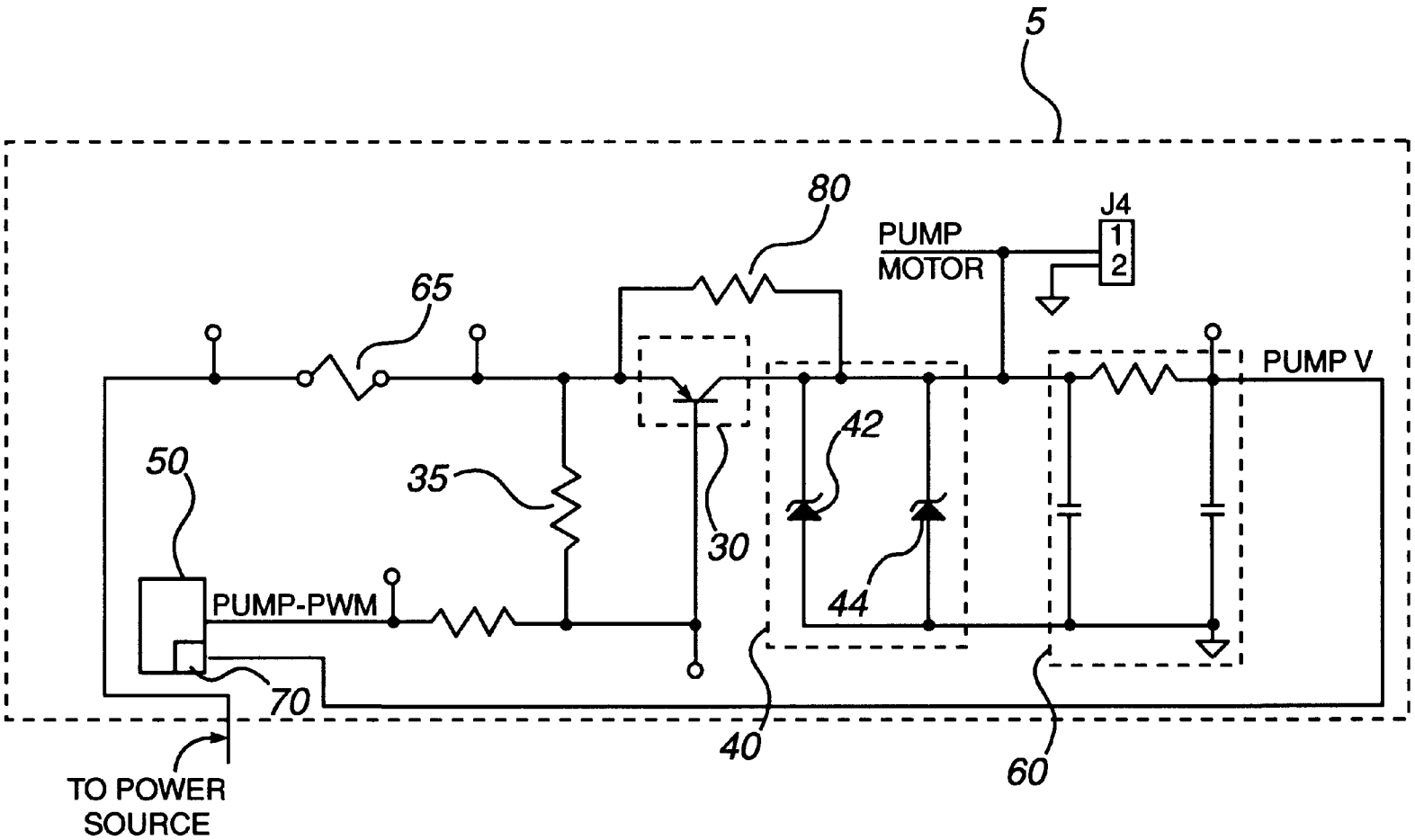
FIG. 2 is a circuit diagram of a control system of the present invention.

A circuit diagram of control system 5 is illustrated in FIG. 2. In general, system 5 is powered by battery 20 and constructed of transistors, capacitors, resistors and diodes, the functions of which are known to those skilled in the electrical arts. For purposes of simplicity, the discussion of control system 5 below mainly emphasizes the interrelationships of the principal subcircuits thereof which are illustrated in FIG. 1 and bounded by dashed lines in FIG. 2.

Preferably, the power to control system 5 is supplied through a power switch when the gas detection instrument is turned on. In the event of a fault the pump supply is protected by a fuse 65 such as a 250 mA fuse. During each on-off cycle, transistor switch 30 is turned on when pump control line (PUMP-PWM) from microcontroller 50 is pulled low and supplies transistor switch 30 with a base drive. The positive terminal of the pump motor 10 is connected to either a J4 pin 1 on the main board or through a battery pack connector pin. The negative terminal of motor 10 is connected to ground at J4 pin 2 or to ground in the battery pack. While transistor switch 30 is on, it preferably supplies the full battery voltage to motor 10. During the "off" portion of cycle, no power is supplied to motor 10 from battery 20. A resistor 35 is preferably used to help turn off transistor switch 30 at the beginning of the off portion of the cycle. During the off portion of the cycle, motor 10 continues to rotate because of the momentum thereof as discussed above. The resultant back emf of motor 10 is preferably redirected to motor 10 using regenerating circuitry 40 comprising, for example, two clamping diodes 42 and 44. The voltage across the motor windings is preferably averaged by a low pass filter 60. A signal proportional to this average voltage is preferably transmitted (via line PUMP V) to and measured by an analog-to-digital converter (A/D) 70 in microcontroller 50. A resistor 80 is preferably used to supply a small bias current to low pass filter 60 to determine if a pump is attached to the instrument.

By controlling the motor voltage, the speed of motor 10, and thereby the flow rate of the pump, are maintained in a relatively small operating range. Efficient motor control maximizes the life of battery 20. The normal operating conditions of motor 10 under light and heavy loads are preferably characterized to determine the maximum and minimum duty cycle required for motor 10 over battery voltage changes and operating temperature changes normally experienced during use thereof. These maximum and minimum values are preferably used to determine normal operating limits for motor 10 and to detect problems in the flow system such as a sample line failure or a motor failure. A clogged sample line or a stalled motor condition, for example, is detected by a low average motor voltage. A burned out motor winding or an open commutator circuit is detected by the absence of the regenerated voltage.

The present invention also provides a system and a method for detecting more marginal fault conditions, for example, caused by sudden changes in pneumatic loading. Such sudden changes may occur, for example, when a liquid is inadvertently drawn into the free end of the sample line or when the sample line is restricted by a crushing force somewhere along its length. In one embodiment, control system 5 measures the rate of change in the value of the PWM required to maintain the average motor voltage constant. Once a predetermined center point or control point of average motor voltage is obtained, microcontroller 50 thereafter continuously adjusts the PWM to maintain the voltage constant and computes the rate of change in the PWM. The computed rate of change is continuously compared to an empirically determined normal, acceptable value of rate of change and any deviation in the computed rate greater than this acceptable rate is interpreted by microcontroller 50 as a flow system failure or fault condition.

In another embodiment microcontroller 50 causes a momentary shutdown of the PWM supply signal on a periodic basis and subsequently verifies the generation of an acceptable average motor voltage within a set time interval after the resumption of the PWM supply signal. This procedure is referred to as a PULSE CHECK procedure in FIG. 3. The periodic shutdown preferably occurs approximately every 15 seconds. This period is sufficiently frequent to monitor the pump and sample system performance, but not so frequent as to materially reduce the effective sample flow rate. The PWM shutdown period in this embodiment is preferably approximately 0.2 second. This shutdown period is sufficiently long to cause motor 10 to stall (that is, to slow or stop) and to allow the checking of the acceleration of motor 10 upon resumption of PWM within a predetermined interval of time. In this embodiment, the interval chosen for motor 10 to accelerate to a defined average voltage is preferably approximately 1.5 seconds after the resumption of the PWM supply signal. While 1.5 seconds is an appropriate value around room temperatures, at lower temperatures more time is preferably allowed because of the slower acceleration of motor 10 arising from the "stiffness" of the mechanical components of the pump at such lower temperatures. Absent a marginal fault, motor 10 will restart successfully (that is, within the defined time interval after the resumption of the PWM motor 10 will again be regenerating an acceptable average voltage). A failure to "successfully" restart indicates a fault condition. For example, a marginal fault condition causing an excessive demand for motor torque upon restart is detected as a lower than normal average voltage at the end of the time interval and is interpreted by microcontroller 50 as a flow system failure. The present inventors have discovered that testing the pump's demand for motor torque at a predetermined PWM provides a valuable check for a number of fault conditions.

Figure 3:
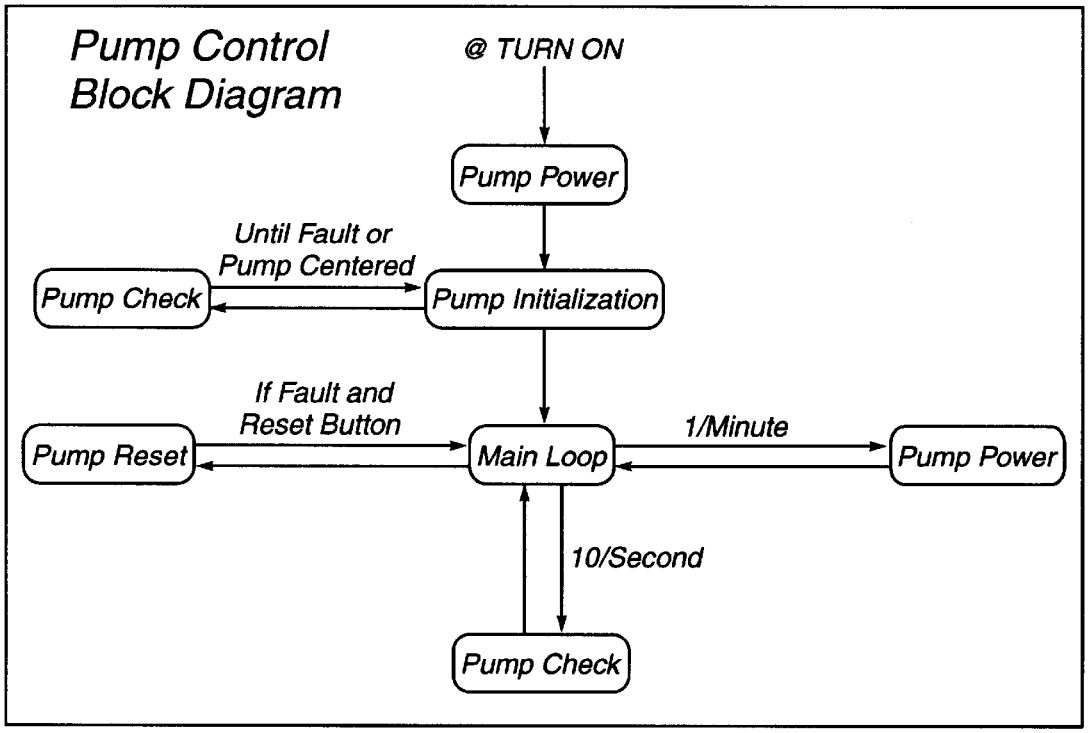
FIG. 3 is a flow chart of an embodiment of a pump control process of the present invention.
Figure 4:
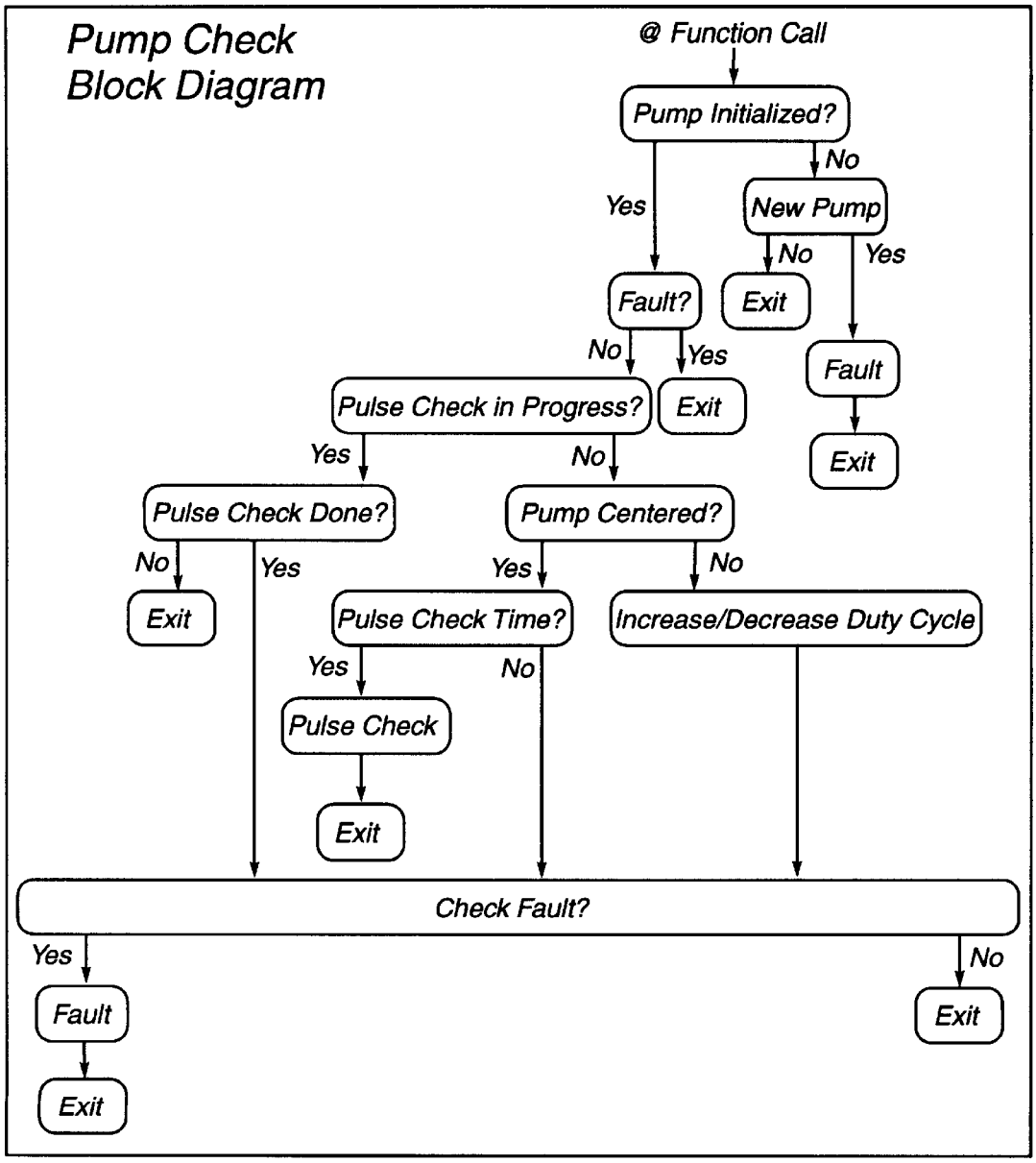
FIG. 4 is a flow chart of an embodiment of a pump check process of the present invention.

An embodiment of a control procedure and fault detection procedure for a gas detection instrument that may be operated in a diffusion mode (that is, relying on diffusion to bring environmental gasses to the one or more sensors of the instrument) or a forced flow mode (that is, using a pneumatic pump to draw environmental gasses to the one or more sensors of the instrument) is illustrated in FIGS. 3 and 4 and in the pseudocode of the Appendix hereto. Under this procedure, when the power switch of the gas detection instrument is turned on, a pump initialization procedure begins. Microcontroller 50 preferably first checks to see if motor 10 is connected within the instrument by measuring if a motor signal (back emf) is being generated. If no motor signal is detected, the pump initialization procedure is exited and the gas detection instrument is readily operated in a diffusion mode.

If motor 10 is detected, the duty cycle is set to 100% (percent on) for approximately 0.5 seconds. Microcontroller 50 measures the power available from battery 20, and then sets the duty cycle to a maximum duty cycle previously established for the measured battery voltage. A maximum duty cycle and a minimum duty cycle for given battery voltage ranges are preferably established experimentally for a given pump and motor combination to provide an acceptable flow rate. For example, for the motor and pump combination controlled via the pseudocode of the Appendix, a maximum duty cycle of 80% and a minimum duty cycle of 5% were experimentally established to provide an acceptable flow rate for a battery voltage of greater than approximately 3.6 volts. For a battery voltage equal to or between approximately 3.6 and 3.3 volts, the maximum and minimum duty cycles were experimentally determined to be 90% and 5%, respectively. For a battery voltage less than approximately 3.3 volts, the maximum and minimum duty cycles were experimentally determined to be 100% and 5%, respectively.

A PUMP CHECK procedure (best illustrated in FIG. 4) is initiated after the duty cycle is set to the maximum duty cycle for the measured battery voltage. The PUMP CHECK procedure first determines if a pump has been added to the gas detection instrument since the instrument has been turned on. If the pump is newly added, a fault is preferably indicated and the user is required to actuate a reset button to begin initialization of the newly added pump. Likewise, removal of a pump preferably results in a fault indication requiring the user to actuate the reset button to continue to operate the instrument in the diffusion mode.

The PUMP CHECK procedure is exited if a fault condition has been detected and a fault indication been given. Upon initialization after turning on the instrument, however, fault indications are preferably delayed for up to 15 seconds for centering. If no fault condition has been detected, the PUMP CHECK procedure determines if a PULSE CHECK procedure is in progress. During initialization, however, the PULSE CHECK procedure is preferably disabled for a period of 30 seconds. If no PULSE CHECK procedure is in progress, microcontroller 50 preferably attempts to adjust the duty cycle in a manner to achieve a motor signal (average back emf voltage) centered between a maximum acceptable average voltage and a minimum acceptable average voltage experimentally determined to efficiently provide an acceptable flow rate. For example, for the pump and motor combination in the pseudocode the maximum and minimum motor signals were established to be approximately 1.95 and 1.85 volts, respectively. Microcontroller 50, thus attempts to adjust the duty cycle to achieve a motor signal of approximately 1.90 volts. A motor signal in the range of approximately 1.85 to 1.95 volts is preferably considered to be centered, however. If pump motor 10 is not centered within 15 seconds, a pump fault is preferably indicated by an electronic alarm system 90 such as an alarm light and/or an alarm sound.

If motor 10 is centered, the PUMP CHECK procedure checks whether it is time for a PULSE CHECK procedure.

If yes, the PULSE CHECK procedure as described above is initiated. If no, microcontroller 50 checks for faults. As discussed above, during operation of the gas detection instrument the average back emf or motor signal is preferably centered between 1.95 and 1.85 volts to maintain a suitable flow rate. Fault indications are enabled only when the motor signal is maintained in this range. If the duty cycle has been set to the minimum duty or the maximum duty for one second or more in controlling motor 10, a fault is indicated. Moreover, if the motor signal is less than approximately 1.4 volts for one second or more, a fault is indicated. Further, if the rate of change of the duty cycle is greater than 5% during a five second interval, a fault is indicated. Like the maximum and minimum duty cycles and the target motor signal range, the 1.4 volt minimum motor signal and 5%/5 second rate of change thresholds or fault conditions are readily determined experimentally for the pump and motor combination in use. If no fault condition is identified, the PUMP CHECK procedure is exited. After initialization, the PUMP CHECK procedure or function is preferably called or executed periodically (for example, 10 times per second).

Any time a fault condition is identified, the duty cycle is determine to its minimum duty cycle for the battery voltage. Preferably, the PUMP CONTROL procedure checks the battery voltage periodically (for example, once per minute) to set the appropriate maximum and minimum duty cycles.

In the PULSE CHECK procedure set forth in the pseudocode, microcontroller 50 determines if the average voltage across motor 10 is less than 1.4 volts after a start-up period of approximately 1.5 seconds if the temperature is greater than or equal to 5° C. If the temperature is less than 5° C., the determination is made after a period of approximately 2 seconds. If the motor signal is less than 1.4 volts after the start-up period, a fault is indicated. The start-up voltage threshold of 1.4 volts is determined experimentally for a particular pump and motor combination.

The target motor signal range, the maximum and minimum duty cycles and the fault condition parameters set forth above were experimentally determined for any combination of two commercially available motors with three commercially available pumps. The motors are motor model no. 1624T006S available from Micromo Electronics, Inc. of Clearwater, Fla. and motor model no. 2316.936-00.141 available from Maxon Precision Motors, Inc. of Burlingame, Calif. The pumps are pump model no. 03.08.005 available from T-Squared Manufacturing Corp. of Nutley, N.J., pump model no. 5D2-4-HE available from Gast Manufacturing Corp. of Benton Harbor, Mich., and pump model no. 3003 available from ASF Thomas of Norcross, Ga.

The pump and motor combinations were tested over a range of load conditions, temperature conditions and battery voltages. The normal (unblocked) load condition was varied from a minimum with a 5 foot long sample line in place to a maximum with a 75 foot long sample line in place. The temperature was varied over a range of approximately −20° C. to 50° C. Three 1.2 volt batteries were connected in series as a power source. A flow rate in the range of approximately 200 to 300 ml/min was preferably maintained. An average motor voltage (over both the on and off portions of the PWM cycle) in the range of approximately 1.85 to 1.95 volts was found to provide a flow rate in the preferred range over the varying load conditions, temperature conditions and battery voltages studied.

The preferred fault parameters or thresholds were established by simulating various fault conditions. For example, the flow was partially or fully blocked, and the response of the motor signal was studied. The "dynamic" tests of the PULSE CHECK procedure and the measurement of the rate of change of modulation of the switch were generally found to provide a quicker indication of partially or full blocked flow fault condition than measurement of the duty cycle percent on. Moreover, the PULSE CHECK procedure and the measurement of rate of change of modulation can give valid fault indications even in the case of one or more leaking pump valves. In addition to providing some indication of flow blockages, measurement of the duty cycle percent on provides an indication of motor fault conditions such as an open commutator or a broken shaft.

As clear to one skilled in the art, the various fault detection systems and methods disclosed herein can be used collectively (as demonstrated in the pseudocode of the Appendix) or individually to detect pumping fault conditions in gas detection instruments. Preferably, the user periodically simulates blockage to test the continued operation of such systems and methods.

Although the present invention has been described in detail in connection with the above examples, it is to be understood that such detail is solely for that purpose and that variations can be made by those skilled in the art without departing from the spirit of the invention except as it may be limited by the following claims.

APPENDIX

1. Pump Initialization
   IF PUMP
   DUTY ON=100%
   WAIT 0.5 SEC
   DUTY ON=MAX FOR BATT VOLTAGE
   FAULT DELAYED FOR 15 SEC OR UNTIL PUMP CENTERED
   PULSECHECK DELAYED FOR 30 SEC
   PUMP CHECK TIL PUMP FAULT OR PUMP CENTERED
2. Pump Check
   IF FAULT OR NO PUMP DO NOTHING
   IF PUMP ADDED FOR FIRST TIME PUMP FAULT
2.1 Pump Pulse Check
   IF PULSE CHECK TIME (ONCE EVERY 15 SECONDS)
   DUTY ON=0
   WAIT 0.2 SECONDS
   DUTY ON=PREVIOUS DUTY ON
   DISABLE FAULT FOR 2 SECS
   DISABLE PUMP CONTROL FOR X SECS
   @END OF X SECS IF EMF<1.4 FAULT
   IF TEMP<5° Celsius, X=2 SECS
   IF TEMP≧5° Celsius, X=1.5 SEC
2.2 Pump Flow Control
   IF PUMP EMF>1.95 VOLTS, DECREASE DUTY ON
   IF PUMP EMF<1.85 VOLTS, INCREASE DUTY ON
   IF 1.85≦PUMP EMF≦1.95 VOLTS, ENABLE FAULTS
2.3 Pump Fault Check
   IF FAULT ENABLED
   IF DUTY ON<MN DUTY FOR 1 SECOND, FAULT
   IF DUTY ON>MAX DUTY FOR 1 SECOND, FAULT
   IF EMF<1.4 FOR 1 FULL SECOND, FAULT
   IF DUTY CHANGE RATE>5% DUTY ON/5 SECONDS, FAULT
   IF FAULT, DUTY ON=MIN DUTY 3. Pump Reset IF PUMP FAULT FROM PUMP ADD, PUMPINIT
IF PUMP REMOVED, DISABLE PUMP
ELSE
CLEAR PUMP FAULT
DISABLE PUMP FAULT FOR 7.5 SECONDS
DELAY PULSECHECK FOR 15 SECONDS
DUTY=MAX DUTY ON FOR BATTERY VOLTAGE 4. Pump Power IF BATT VOLTS>3.6 MAX DUTY ON=80%, MIN DUTY ON=5%
IF 3.6≧BATT VOLTS≧3.3 MAX DUTY ON=90% MIN DUTY ON=5%
If BATT VOLTS<3.3 MAX DUTY ON=100%, MIN DUTY ON=5

What is claimed is:

1. A system for controlling a pump for use in a gas detection device, the system comprising:

a. a power source;

b. a switch in operative connection with the power source, c. a pump motor in operative connection with the switch such that the pump motor receives energy from the power source when the switch is in a first state, and the pump motor does not receive energy from the power source when the switch is in a second state;

d. transmitting circuitry adapted to transmit a motor signal proportional to a speed of the pump motor; and e. a processing unit in operative connection with the switch and the transmitting circuitry, the processing unit adapted to modulate the switch between the first state and the second state, the processing unit being further adapted to control the modulation of the switch in response to the motor signal received from the transmitting circuitry to control the motor; the processing unit being further adapted to compare the motor signal with a predetermined range of acceptable values to determine if a fault condition exists.

2. The system of claim 1 wherein the processing unit is a microcontroller.

3. The system of claim 1, further comprising regeneration circuitry in operative connection with the pump motor, the regeneration circuitry adapted to redirect energy produced from momentum of the pump motor while the switch is in the second state back to the pump motor.

4. The system of claim 1 wherein the motor signal is approximately the voltage across the pump motor at a predetermined point of time during the second state of the switch.

5. The system of claim 1 wherein the motor signal is approximately the average voltage across the pump motor during the second state of the switch.

6. The system of claim 1 wherein the motor signal is approximately the average voltage across the pump motor during the first state and the second state of the switch.

7. The system of claim 6 wherein the transmitting circuitry comprises a low pass filter adapted to approximately average voltage across the pump motor.

8. The system of claim 1 wherein the processing unit is further adapted to periodically cause the switch to be in the second state for a period of time sufficiently long to cause a stall of the pump motor, the processing unit further being adapted to restart modulation of the switch after the period of time at a predetermined duty cycle, the motor signal during restart of the pump motor providing an indication of whether a fault condition is present.

9. The system of claim 1 wherein the processing unit is adapted to measure a rate of change of modulation required to control the pump motor and to compare the measured rate of change with a predetermined value to determine whether a fault condition is present.

10. The system of claim 1 wherein the processing unit is adapted to compare a duty cycle of modulation required to control the pump motor with at least one of a predetermined maximum duty cycle and a predetermined minimum duty cycle to determine whether a fault condition is present.

11. A method of controlling a pump motor for use in a gas detection instrument, the method comprising the steps of:

a. supplying energy to the pump motor from a power source;

b. modulating a switch connected between the power source and the pump motor between a first state in which the pump motor receives energy from the power source and a second state in which the pump motor does not receive energy from the power source, c. measuring a motor signal proportional to a speed of the pump motor; and d. controlling the modulation of the switch in response to the motor signal to control the pump motor.

12. The method of claim 11 further comprising the step of comparing the motor signal with a predetermined range of acceptable values to determine in a fault condition is present.

13. The method of claim 11 further comprising the steps of:

e. periodically causing the switch to be in the second state for a period of time sufficiently long to cause a stall of the pump motor;

f. restarting modulation of the switch after the period of time at a predetermined duty cycle; and g. measuring the motor signal at a predetermined time after restarting modulation of the switch to determine if a fault condition is present.

14. The method of claim 11, further comprising the steps of:

e. measuring a rate of change of modulation required to control the pump motor; and f. comparing the measured rate of change with a predetermined value to determine whether a fault condition is present.

15. The method of claim 11, further comprising the step of:

e. comparing a duty cycle of modulation required to control the pump motor with at least one of a predetermined maximum duty cycle and a predetermined minimum duty cycle to determine whether a fault condition is present.

16. The method of claim 11 wherein the motor signal is approximately the voltage across the pump motor at a predetermined point of time during the second state of the switch.

17. The method of claim 11 wherein the motor signal is approximately the average voltage across the pump motor during the second state of the switch.

18. The method of claim 11 wherein the motor signal is approximately the average voltage across the pump motor during the first state and the second state of the switch.

19. The method of claim 11, further comprising the step of redirecting energy produced from rotation of the pump motor when the switch is in the second state back to the pump motor.

20. A system for controlling a pump comprising:

a. a power source;

b. a switch in operative connection with the power source, c. a pump motor in operative connection with the switch such that the pump motor receives energy from the power source when the switch is in a first state, and the pump motor does not receive energy from the power source when the switch is in a second state;

d. transmitting circuitry adapted to transmit a motor signal proportional to a speed of the pump motor;

e. a processing unit in operative connection with the switch and the transmitting circuitry, the processing unit adapted to modulate the switch between the first state and the second state, the processing unit being further adapted to control the modulation of the switch in response to the motor signal received from the transmitting circuitry to control the motor; and f. regeneration circuitry in operative connection with the pump motor, the regeneration circuitry adapted to redirect energy produced from momentum of the pump motor while the switch is in the second state back to the pump motor.

* * * * *